US005711244A

United States Patent [19]

Knapp

[11] Patent Number: 5,711,244

[45] Date of Patent: Jan. 27, 1998

[54] POLYHEDRALLY STIFFENED CYLINDRICAL (PC) PRESSURE HULL

[76] Inventor: Ronald H. Knapp, 98-1033 Kupukupu Pl., Aiea, Hi. 96701

[21] Appl. No.: 540,212

[22] Filed: Oct. 6, 1995

[51] Int. Cl.[6] ..... B63B 3/13

[52] U.S. Cl. ..... 114/312; 220/669

[58] Field of Search ..... 114/312, 341, 114/342, 257; 220/4.12, 4.13, 562, 565, 669, 673, 675; 52/81.1, 81.4, 81.5, 80.1; 405/185

[56] References Cited

U.S. PATENT DOCUMENTS

| | | | |
|---|---|---|---|
| 3,329,297 | 7/1967 | Jordan | 114/341 |
| 3,598,275 | 8/1971 | Francois . | |
| 3,608,767 | 9/1971 | Elliott et al. | 220/4.12 |
| 3,760,753 | 9/1973 | Mertens . | |
| 4,058,945 | 11/1977 | Knapp . | |
| 4,825,602 | 5/1989 | Yacoe | 52/81.4 |
| 4,928,614 | 5/1990 | Forman | 114/341 |
| 5,100,017 | 3/1992 | Ishinabe | 220/669 |
| 5,249,997 | 10/1993 | Nance | 114/341 |

OTHER PUBLICATIONS

Ronald H. Knapp, "Pseudo–Cylindrical Sells: A New Concept for Undersea Structures", Journal of Engineering for Industry, vol. 99, No. 2, Mat 1977.

*Primary Examiner*—Sherman Basinger
*Attorney, Agent, or Firm*—James Creighton Wray

[57] ABSTRACT

A structure for a pressure and buckling resisting hull has an undulated shell body with flat, plural, polyhedral faces, shell caps at the ends, and transition sections attaching the shell caps to the shell body. The shell body polyhedral faces may be generally triangular or generally trapezoidal and are truncated triangular in shape for reducing material stress and for increasing buckling resistance. The top-to-base length ratios of the truncated triangular shapes are selected to optimize structural performance so that differences between maximum stress-depth and buckling-depth curves are minimized. Transition sections are conoidal in shape or are formed by portions having alternating flat triangular faces with curved triangular faces. Buckling strength and material stress are reduced or increased by using transition sections which are longer or shorter than the polyhedral faces in the shell body.

33 Claims, 4 Drawing Sheets

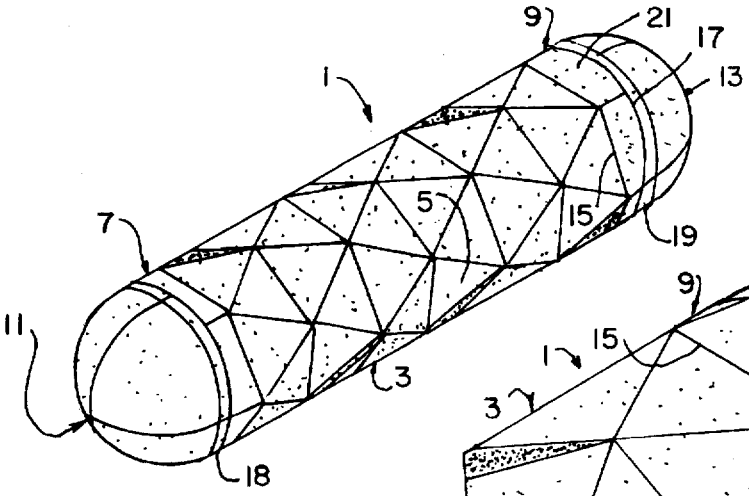
FIG. 1
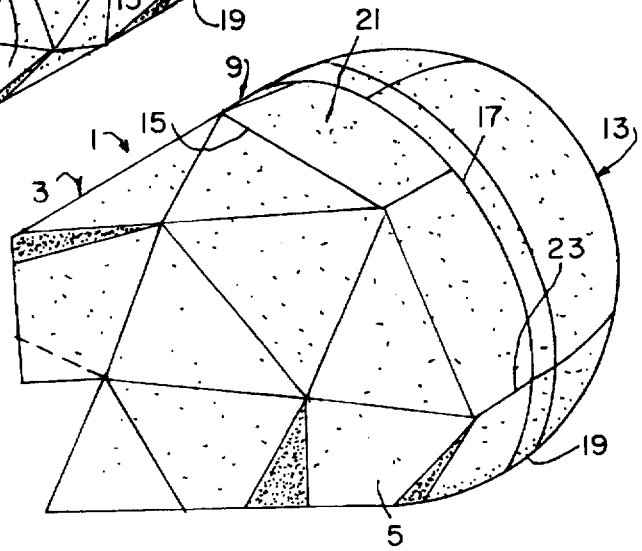
FIG. 2
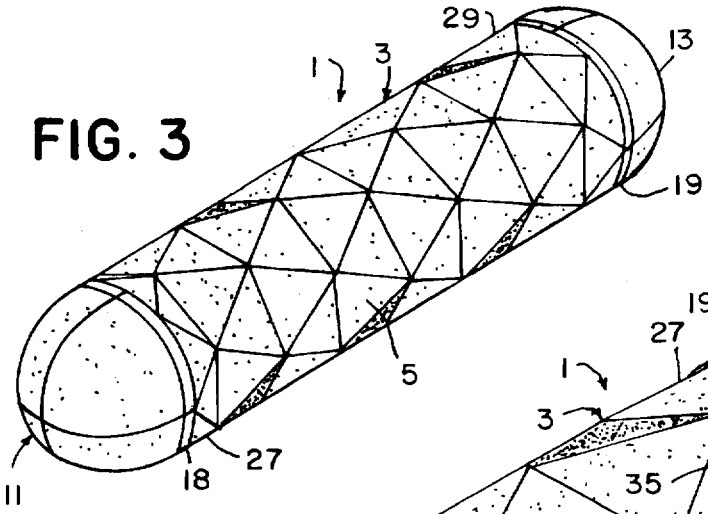
FIG. 3
FIG. 4
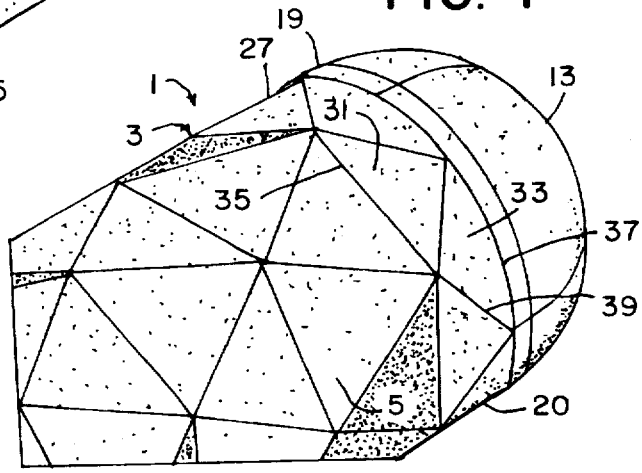

POLYHEDRALLY STIFFENED CYLINDRICAL (PC) PRESSURE HULL

BACKGROUND OF THE INVENTION

The present invention relates to pressure resistance structures, especially externally pressurized structures for underwater or underground systems.

In the past, externally pressurized circular cylindrical (CC) hull structures have been developed that require circumferential stiffening rings or excessive shell wall thicknesses to prevent buckling failure. In addition, both the cylindrical hull and rings must be formed accurately along circular arcs to preserve buckling strength.

Currently much attention is being given to the use of composite material hulls that require metal or composite reinforcing rings. Fitting the metal rings to the composite hulls or integrally molding composite rings into the shell wall requires precision and introduces difficulties.

A curved overall surface formed with planar polyhedral surfaces has also been used. Known structures required axial restraints and internal structures and do not provide a means to utilize conventional end structures and seals available for CC hulls.

Needs exist for shell structures with increased buckling strength and reduced material, manufacturing and structural requirements to provide improved pressure vessels.

The present invention eliminates disadvantages and fulfills longstanding needs of the prior art.

SUMMARY OF THE INVENTION

The present invention relates to a new pressure-resisting structure for polyhedrally stiffened cylindrical (PC) shells and new means for enclosing the PC shell ends using doubly-curved and developable shells such as hemispherical, ellipsoidal and conical shells or flat plate plugs. The present invention also relates to new transition sections between the shell body and the shell ends. The shape of such transition sections can strongly affect the useful depth (pressure) of the PC shell.

Preferably the hulls have PC shell bodies formed of triangular or truncated triangular (trapezoidal) polyhedral sections. Transition sections formed with angularly related linear edge segments at the inner ends and circular edges at the outer ends are joined at inner edges to axial ends of the PC shell body. Cylindrical ring sections are connected axially outwardly on the transition sections. End caps which can be shell or flat plate structures and which may be sealed and removable are connected axially to the rings.

The present invention advances composite pressure hull development by eliminating the need to integrally mold or structurally bond stiffening rings into CC shells.

The shell structure according to the present invention provides greater buckling and pressure resistance than a geometrically comparable CC hull, and at reduced cost. The shell structure of the present invention has an undulated body with a plurality of flat polyhedral faces and plural shell or plate ends. Plural transition sections attach the shell body to the shell ends.

In the present invention preferred elements in the PC shell body have generally triangular shapes with the apex sometimes removed to form a trapezoidal shape. Usually, the apex is removed on a line parallel to the base. The shapes are generally referred to as trapezoidal herein even when the top is parallel to the base. Removing the apex reduces material stress while substantially retaining buckling resistance. Ideally, a cylinder constructed according to the present invention would concurrently fail due to material stress and buckling.

Modular flat surfaces for a PC hull result in geometrical simplicity and greatly reduces costs of construction. The precise geometry to achieve optimal structural performance depends on the operating depth, material, the shell radius-to-thickness ratio, the length-to-radius ratio, the number of axial polyhedra and the number of circumferential polyhedra.

To join the circular edge of the end enclosure to the polyhedral edge of the PC shell body, this invention provides transition sections having conoidal shapes or formed by alternating flat triangular faces and curved triangular faces.

For large diameter hulls, the circular cylinder found in the prior art is expensive to fabricate since circularity, which is critical to its buckling strength, must be accurately controlled. Since the PC shell has an undulating surface, circumferential bending rigidity is greater than in a circular cylinder with the same wall thickness.

PC shells are not as sensitive to variations of geometry as are CC shells to circularity. Small variations in the shape of the PC shell of the present invention do not reduce buckling strength to the degree they would in a prior art circular cylinder. The ratio of PC hull buckling pressure to CC hull buckling pressure generally increases with increasing geometrical imperfection. Since fabrication tolerances for PC shells can be made larger than those for circular cylinders, it is possible to reduce manufacturing costs. Since the PC shell is an inherently stiffened cylinder, stiffening rings used in the prior art are unnecessary.

With mass-production molding, forming and joining techniques of PC shell "modular units", increased dimensional tolerances and lower material costs, manufacturing costs of the PC hull are lower than conventional CC hulls.

PC shells of the invention have substantial structural advantages over CC shells with similar overall geometry. For the same operational pressure, structural weight is reduced for any pressure hull material, and additional payload is gained by using PC hull technology. Alternatively, for the same structural weight, operational pressure can be significantly increased.

Transition sections and cylindrical rings allow the mounting and sealing of end caps which are connected axially to the rings.

These and further and other objects and features of the invention are apparent in the disclosure, which includes the above and ongoing written specification, with the claims and the drawings.

BRIEF DESCRIPTION OF THE DRAWINGS

FIG. 1 is a perspective view of the PC shell of the present invention with flat triangular faces, conoidal transition sections with straight and curved edges, cylindrical rings and hemispherical end caps.

FIG. 2 is a detail of the embodiment shown in FIG. 1.

FIG. 3 is a perspective view of the invention having a body with flat triangular faces, transition sections formed by alternating flat triangular faces and curved triangular faces, cylindrical rings and hemispherical end caps.

FIG. 4 is an enlarged detail of the embodiment shown in FIG. 3.

DETAILED DESCRIPTION OF THE DRAWINGS

Figure 5:
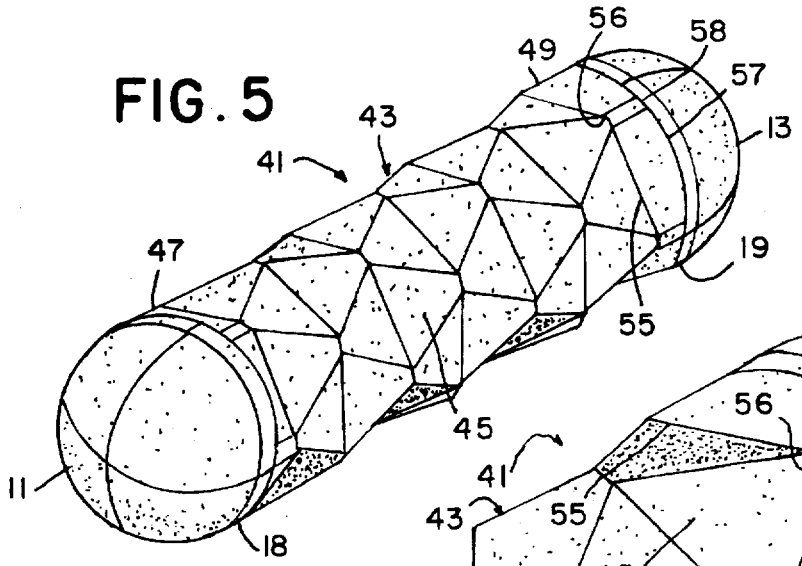
FIG. 5 is a perspective view of the PC shell of the present invention with flat trapezoidal faces, transition sections formed by alternating narrow and wide conoid sections, cylindrical rings and hemispherical end caps.

FIGS. 1 and 2 show one preferred embodiment of the PC hull of the invention. The overall PC hull is generally indicated by the numeral 1. The PC shell body 3 is formed with flat polyhedral, triangular faces 5 of constant or variable axial lengths. Transition sections 7 and 9 are based on a conoidal shell structure and connect shell body 3 with circular rings 18 and 19 that connect to hemispherical shell ends 11 and 13. Transition sections 7 and 9 have edges 15 shaped to fit against the shell body 3 and circular edges 17 that fit against the circular rings 18 and which in turn are connected to the hemispherical shell ends 11 and 13. As shown in the drawing, the distances of edges 15 from a longitudinal axis of a shell body 3 are similar to the distances of edges 17 from the longitudinal axis. The ends 11 and 13 may be hemispherical, ellipsoidal, conical or other singly or doubly curved shells or a circular flat plate structure. The transition sections 7 and 9 are made with faces 21 connected by edges 23.

Figure 12:
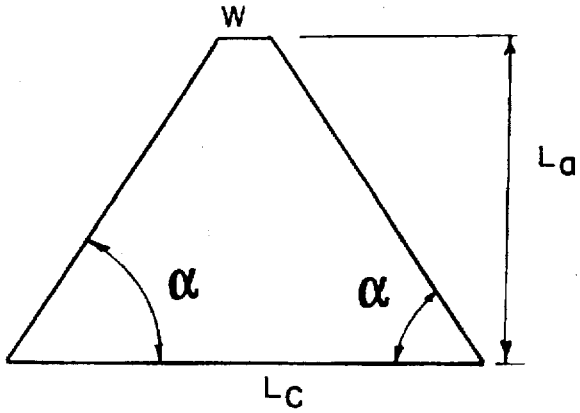
FIG. 12 is a representation of the geometry of the flat trapezoidal faces forming the shell body of the embodiment shown in FIG. 5.

The precise geometry of the polyhedral faces is determined based on the magnitude of pressure loading, type of material used, the shell radius-to-thickness ratio, R/T, the shell length-to-radius ratio, L/R, the number of axial polyhedra, M, and the number of circumferential polyhedra, N. The geometry of a polyhedral face is described in FIG. 12, in terms of the angle alpha, $\alpha$, circumferential length, $L_c$, axial length, $L_a$, top width, W, and trapezoidal ratio, $W/L_c$. The circumferential length, $L_c$, depends on the shell radius, R, and the number of circumferential polyhedra, N. The axial length, $L_a$, can be varied along the shell length, L, to achieve varying buckling stiffness where external pressure varies along L, such as in a vertical orientation of the shell. Optimal structural performance is achieved by adjusting the angle alpha, $\alpha$, and the top width, W, and the circumferential length, $L_c$, such that the PC shell fails ideally by material yield and buckling simultaneously. Also these geometrical parameters can be varied to achieve a preferential failure mode such as material yield before buckling.

Parametric design studies emphasize optimizing structural performance by variation of the PC hull geometry. The shape of the polyhedra may be varied according to the geometry depicted in FIG. 12. The angle, $\alpha$, and trapezoidal parameter, $W/L_c$, are varied to achieve desired buckling and stress-depth curves for a specific material.

Another preferred embodiment of the transition sections of the present invention is depicted in FIGS. 3 and 4. The overall PC hull 1, the PC shell body 3, and faces 5, ends 11 and 13 and connecting rings 18 and 19 are similar to those shown in FIGS. 1 and 2. In FIGS. 3 and 4 transition sections 27 and 29 use alternating triangular flat faces 31 (identical to the rest of the PC shell body) and curved triangular faces 33. Flat faces 31 have straight edges 35, curved faces 33, have curved edges 37 which connect to circular rings 18 and 19. Faces 31 and 33 are connected by intermediate straight edges 39. Flat faces 5 form the PC shell body 3.

Figure 6:
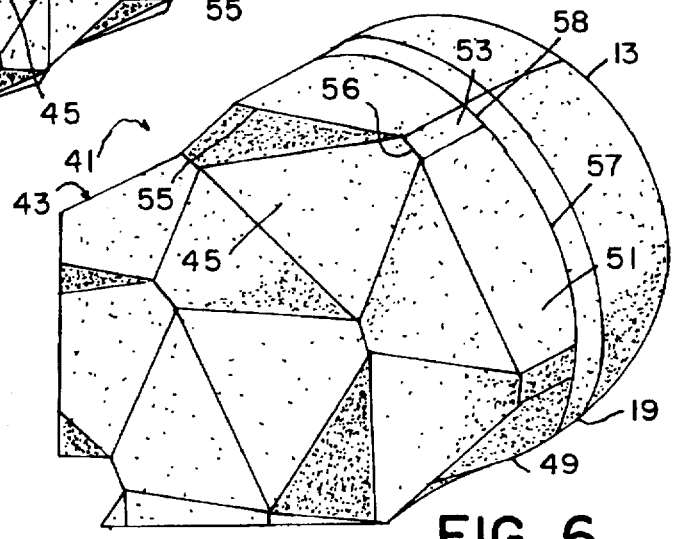
FIG. 6 is a detail of the embodiment shown in FIG. 5.

FIGS. 5 and 6 depict an overall PC hull body 41. Trapezoidal polyhedral sections 45 form the PC shell body 43. Finite element analyses have shown that the trapezoidal shape reduces the stress concentration along the edge width, W (FIG. 12), while also reducing buckling resistance. Moreover, these analyses have shown that decreasing the angle, $\alpha$, from about a 60 degree equilateral triangular geometry increases buckling resistance. Circular rings 18 and 19 and hemispherical ends 11 and 13 are connected to the PC shell body 43 by transition sections 47 and 49. Wide conoidal transition sections 51 and narrow conoidal transition sections 53 have straight edges 55 and 56 and curved edges 57 and 58 that are connected to cylindrical rings 18 and 19.

Figure 7:
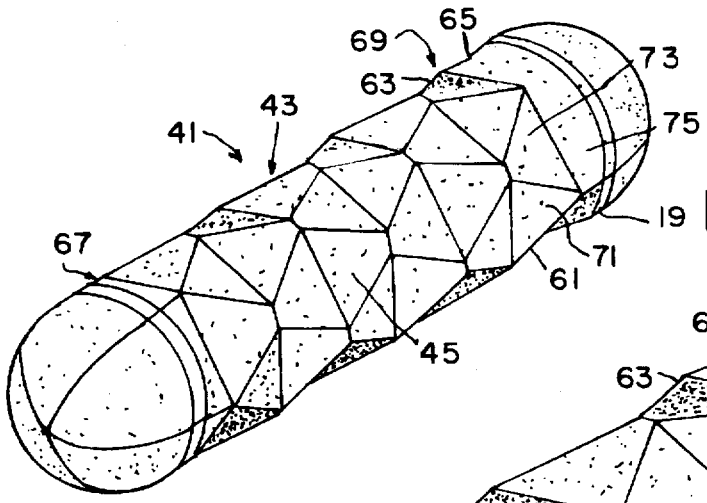
FIG. 7 is a perspective view of the invention having a body with flat trapezoidal faces, transition sections formed by uniform conoid sections, cylindrical rings and hemispherical end caps.
Figure 8:
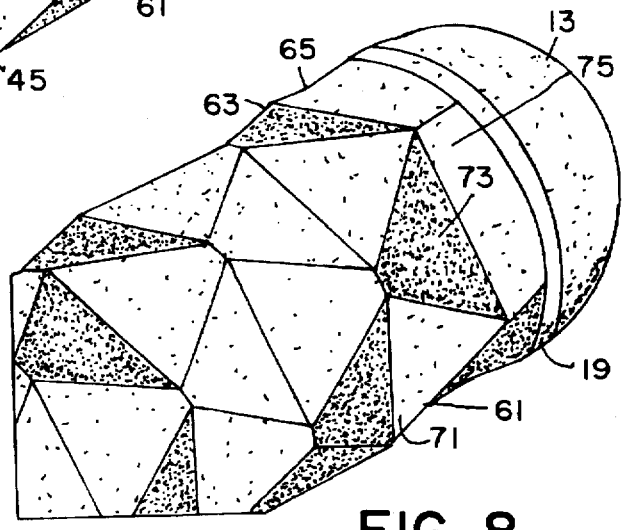
FIG. 8 is a detail of the embodiment shown in FIG. 7.

FIGS. 7 and 8 show PC hull 41 with PC shell 43 and faces 45 similar to those shown in FIGS. 5 and 6. Three axial parts 61, 63 and 65 form each of the transition sections 67 and 69. Parts 61 are made of triangular faces 71. Parts 63 are made of truncated or trapezoidal faces 73. Parts 65 are made of elements 75 similar to elements 21 shown in FIG. 1.

Figure 9:
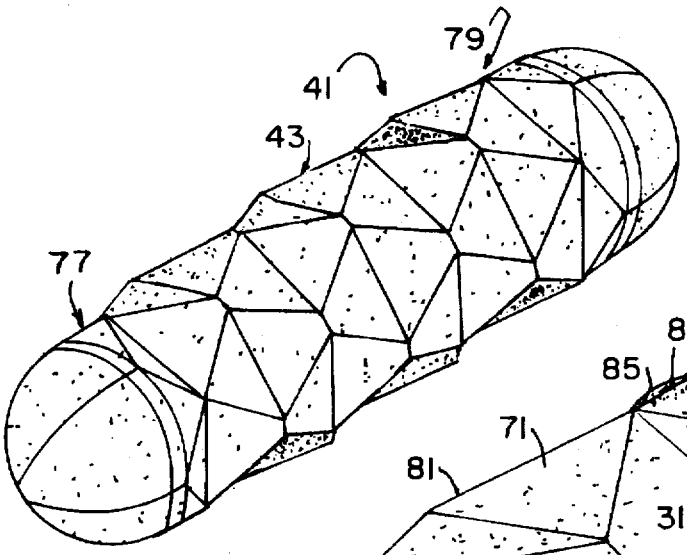
FIG. 9 is a perspective view of the PC shell of the present invention with flat trapezoidal faces, transition sections formed by alternating flat triangular faces and curved triangular faces, cylindrical rings and hemispherical end caps.
Figure 10:
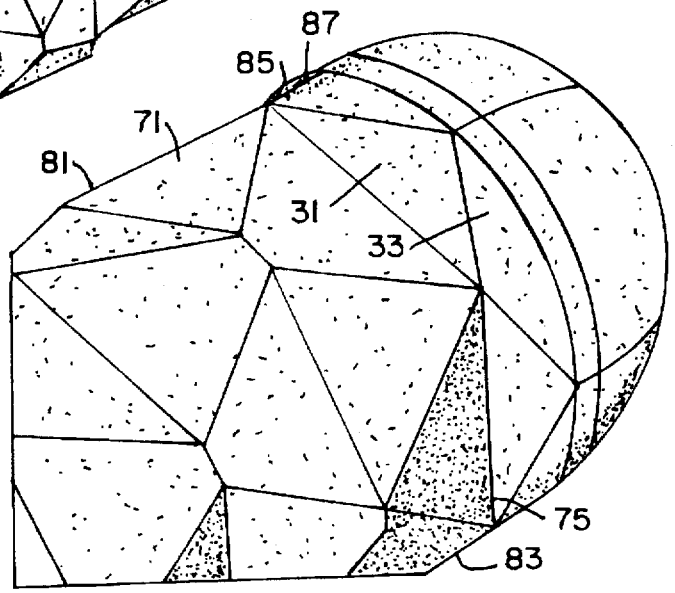
FIG. 10 is a detail of the embodiment shown in FIG. 9.

FIGS. 9 and 10 show the use of four-part transition sections 77 and 79 at ends of PC shell 43 of PC hull 41.

Part 81 is made of triangular faces 71 and part 83 is made of trapezoidal faces 75. Parts 85 and 87 are constructed, respectively, of flat triangular faces 31 and curved faces 33, similar to those shown in transition section 27 shown in FIG. 4.

FIG. 7 depicts a trapezoidal PC shell body 43 joined to the hemispherical ends by uniform conoidal transition sections. This is accomplished by terminating the trapezoidal polyhedra adjacent to the transition region at triangular vertices.

The PC shell can be fabricated by welding identical polyhedral plates or by molding with a composite material. Fabrication is simplified since geometrical tolerances do not require the same degree of control as in manufacturing the circular cylinders found in the prior art.

Most structural materials, including metals such as steel or aluminum and composites, such as E-glass/epoxy, S-glass/epoxy and carbon/epoxy can be used in the construction of PC hulls. Also, transparent materials, such as acrylic plastic, can be employed in the construction of PC hulls where visual or photographic observation through the hull is necessary.

The needed hull dimensions, operating depth, frequency of use and cost will determine the best material and manufacturing approach. For large diameter structures, welding metal plates may be suitable, whereas for small diameter structures, molding with composite materials may be a more economical approach.

Whether made by molding or by welding identical modular units together, the PC shell of the present invention simplifies the manufacturing process. Material handling is simplified because of the smaller size and weight of the polyhedral flat plates. Hull penetrations may be made through flat, not curved, surfaces. That simplifies designing seals and provides good structural connections.

Longitudinal or ring stiffeners required to increase the buckling resistance of a circular cylinder are unnecessary due to the inherent stiffening produced by the PC shell geometry. This property is significant to enhance the development of composite pressure hulls. Prior art requires stiffening with rings bonded or integrally joined to the circular cylinder. To reduce stress concentrations requires fillets at the intersection of the ring and circular cylinder. Manufacturing cost of filleted rings in composite hulls is considerably higher than metallic hulls. Also, the effect of stress concentrations on structural failure of the rings is more significant. Since the PC hull requires no rings, development of composite pressure hulls will benefit from this simpler geometry.

The developable geometry of the PC shell provides several opportunities to reduce manufacturing costs according to the following processes.

Molding

PC shells can be made from structural materials such as composites for molding in virtually any thickness. Since the PC shell is a developable surface, fabric can be applied to the mold surface without any distortion or stretching of the fabric.

Folding

The PC shell may be produced through a folding action rather than a stretching action. The flat faces 5 of the shell body 3 shown in FIG. 1 may be formed by folding an originally flat surface into an undulating surface with both convex and concave regions. PC shells can be produced from thin metal plates by fold-forming over a mold or forge mandrel. Joining the PC shell mold can be formed with identical polyhedral faces. These polyhedra can be mass-produced economically from thick metal or plastic plates and assembled by welding or bonding in an assembly fixture.

Figure 11:
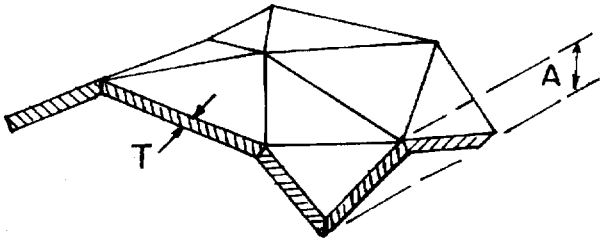
FIG. 11 is a cross-sectional view of a folded surface used to form the flat faces of the shell body of the present invention.

FIG. 11 depicts that geometry with the amplitude of undulation given by the distance A relative to the shell thickness, t. The undulating surface, much like the structural action of corrugated metal, adds structural stiffness to the shell. Structural stiffness limits deflection and increases buckling resistance. Unlike the convex surface of a prior art geodesic dome that has less buckling strength than the sphere, the undulating surface of the PC shell always has a larger buckling strength than the circular cylinder. Molding with composite materials or fold-forming metal plates may offer the lowest manufacturing cost for PC hulls up to several feet in diameter. Larger diameter hulls may be more economical to produce by welding or bonding individual polyhedral flat plates.

The PC shell of the present invention is structurally superior. The axial length of the transition sections is significant. A longer length generally reduces and a shorter length generally increases buckling strength.

Figure 13:
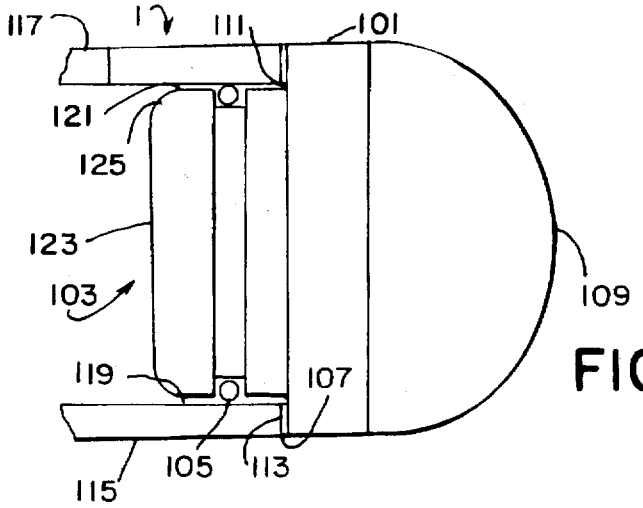
FIG. 13 shows a removable, sealed end structure.

As shown in FIG. 13, the PC hulls 1 may be formed with flat ends 101. The flat ends 101 may be used for joining multiple hull sections together, such as by abutting one flat end with another flat end of a second hull section.

In one form of the invention, the PC shell structure is constructed with removable ends 103, with piston type O-ring pressure seals 105 and face seal gaskets 107 (alternatively O-ring face seals) for applications such as instrumentation housings.

Flat plates or solid plugs 103 form the ends. In one example, a dome-shaped nonstructural fairing 109, which is optional, axially extends from flat end 101 of plug 103. The plug 103 has a flat annular inner shelf 111, which overlies a flat annular end 113 of a cylindrical ring 115 on the end of a PC hull transition section 117. An annular elastomeric face seal or gasket 107 with compliant surfaces is interposed between the two annular surfaces 111 and 113 to transmit axial force more uniformly.

O-ring seal 105 is positioned between an inner wall 119 of the ring section 115 and a cylindrical wall 121 of the plug 103. End 123 of plug 103 is curved 125 to reduce stress concentrations in the shell wall.

Table 1 is an exemplary list of several potential PC hull applications for the present invention. Uses are not limited to those described. Many other applications are possible. One of the most promising applications identified is the Autonomous Underwater Vehicle (AUV). AUV's of varying sizes and configurations have both military and commercial uses over a wide range of depths. Because of its undulated surface, a PC hull used for mobile systems such as AUV's has higher hydrodynamic drag, although an external cylindrical fairing can be added to reduce drag.

Figure 14:
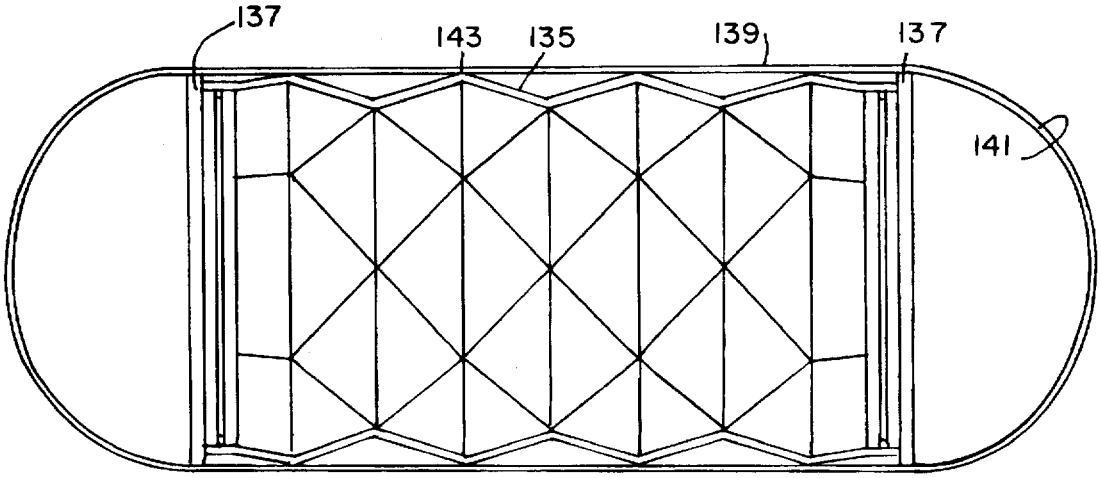
FIG. 14 shows a PC shell with flat plate end caps, a cylindrical fairing over the PC shell and hemispherical end fairings. The fairings serve to reduce hydrodynamic drag and can also provide additional axial stiffness to the structure.

FIG. 14 shows a cross-sectional view of the PC shell 135, flat end plate plugs 137, a cylindrical fairing 139 and a endcap fairing 141. The cylindrical fairing 139 may be attached to the end caps 137 and along points 143 of intersection with the PC shell and may be used to add structural stiffness in the axial direction.

In preferred embodiments, the polyhedral faces have ratios of top widths to base lengths of from 0 (triangular faces) to less than 1 (trapezoidal faces) for increasing buckling resistance or for reducing stress.

Preferably, the top to base length ratio of the polyhedral faces are selected to optimize structural performance such that the difference between the maximum stress-depth and buckling-depth curves is minimized.

The faces are preferably triangular in form and have top to base length ratios of from 0 to less than 1 and have base-side inclulded angles of from about 20° to about 75°, depending on material, operating pressure (depth) and application.

Many of the vehicles identified in the exemplary list operate at depths less than 2,000 feet. The U.S. Navy requires AUV's with diameters less than 21 inches to be launched through a torpedo tube. Since some of these are expendable, and low cost is desirable, making the PC hull of the present invention is an ideal choice.

Some of the commercial uses of AUV's include pipeline inspections, hydrographic surveys, side-scan sonar, and oceanographic data collection. One commercial manufacturer produces a 21-inch diameter aluminum hull AUV that has both defense and commercial applications. A less expensive and lighter weight hull can increase its commercial advantage.

Figure 15:
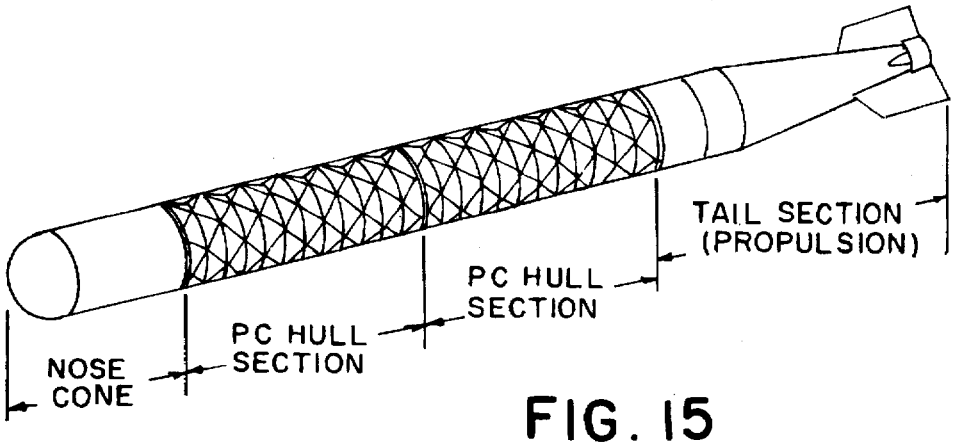
FIG. 15 is an example of how PC shells might be used with autonomous undersea vehicles (AUV's).

Another AUV application is the Long Range Autonomous Underwater Vehicle (LRAUV), a long range oceanographic sensor platform. LRAUV's currently use glass spheres as pressure hulls. As shown in FIG. 15, PC hull sections would replace the glass spheres and would provide more efficient space for instrumentation at lower cost.

Other strong choices for commercial use of PC hulls are instrumentation housings that are 4 to 24 inches in diameter. Those housings are used for cameras, lights, or oceanographic sensors, especially on remotely operated vehicles (ROV's). PC hulls also have potential for larger uses such as welding chambers, ship repair chambers, fuel tanks, influence mine sweeper hulls, buoys, and submersibles, among others. The larger diameter hulls exploit the design characteristics of PC hulls more fully than the smaller applications.

One or more cylindrical ring sections may be connected to the circular ends of the transition sections, or the circular ends of the transition sections may be extended in a cylindrical section before joining the cylindrical structure to the end cap, which may be flat, hemispherical or another shape.

While the invention has been described with reference to specific embodiments, modifications and variations of the invention may be constructed without departing from the scope of the invention, which is defined in the following claims.

TABLE 1

EXEMPLARY LIST OF POTENTIAL PC HULL APPLICATIONS

| Military | Commercial |
|---|---|
| Torpedo-size Unmanned Underwater Vehicle (UUV) | UUV Research Test Platform |
| Data Acquisition Autonomous Underwater Vehicle (AUV) | Oceanographic Data Acquisition AUV |
| Search and Recovery Remotely Operated Vehicle (ROV) | Underwater Inspection ROV |
| Submersible Pressure Hull | Research Submersible Pressure Hull |
| Submarine Pressure Hull | Tourist Submarine Pressure Hull |
| Torpedo | Oceanographic Instrument Housing |
| Mine | Underwater Camera Housing |
| Mine Countermeasures | Underwater Habitat |
| Sonabuoy | Spar Buoy |
| Antisubmarine Warfare (ASW) Training Target | Caisson |
| Pipeline | Pipeline |
| Underwater Fuel Storage Tank | Underground Fuel Storage Tank |
| | Underground Septic Tank |
| | Underwater Welding Chamber |
| | Ship Repair Chamber |
| | Transparent Undersea Aquarium |

I claim:

1. A shell structure apparatus with buckling and pressure resistances, comprising an undulated shell body, having a longitudinal axis and plural polyhedral faces, first and second curved shell ends, and first and second transition sections, said transition sections having first straight edges at inner ends and second edges at opposite outer ends, said first edges being attached to edges of faces of the shell body and said second edges being curved and being attached to the curved shell ends, and wherein a distance of the first edge from the longitudinal axis is similar to a distance of the second edge from the longitudinal axis.

2. A shell structure apparatus with buckling and pressure resistances, comprising an undulated shell body having plural polyhedral faces, first and second curved shell ends, and first and second transition sections, said transition sections having first straight edges at inner ends and second edges at opposite outer ends, said first edges being attached to edges of faces of the shell body and said second edges being curved and being attached to the curved shell ends further comprising circular rings connected outboard to the transition sections.

3. The apparatus of claim 2, wherein each transition section comprises a curved conoidal section with straight inboard edges for connecting to edges of the polyhedral faces of the shell body and circular outboard edges for connecting to the circular ring.

4. The apparatus of claim 3, wherein each transition section comprises multiple elements having straight inboard edges, circular outer edges and interconnecting side edges extending between the straight inboard edges and the circular outer edges.

5. The apparatus of claim 3, wherein each transition section comprises a first inboard part with multiple triangular faces and a second outboard part with multiple, generally triangular conoidal faces.

6. The apparatus of claim 3, wherein each transition section comprises multiple elements having straight inboard edges, circular outer edges and interconnecting side edges extending between the straight inboard edges and the circular outer edges, and further comprising narrow, generally rectangular faces having straight inboard edges, circular outer edges and a side edge connected to the interconnecting side edge of the multiple elements.

7. The apparatus of claim 3, wherein each transition section comprises multiple elements having straight inboard edges, circular outer edges and interconnecting side edges extending between the straight inboard edges and the circular outer edges, further comprising a ring of alternating trapezoidal faces and triangular faces respectively having bases and apexes connected to the straight inboard edges.

8. The apparatus of claim 3, wherein each transition section comprises a first inboard part with multiple triangular faces and a second outboard part with multiple, generally triangular conoidal faces, further comprising a ring of alternating trapezoidal faces and triangular faces respectively having bases and apexes connected to the straight inboard edges.

9. The apparatus of claim 1, wherein the polyhedral faces are formed in triangular shapes.

10. The apparatus of claim 1, wherein the polyhedral faces are formed as truncated triangular or trapezoidal shapes.

11. The apparatus of claim 10, wherein the polyhedral faces have ratios of top widths to base lengths of from 0 with triangular faces to less than 1 with trapezoidal faces for increasing buckling resistance or for reducing stress.

12. The apparatus of claim 11, wherein the top to base length ratio of the polyhedral faces are selected to optimize structural performance such that the difference between the maximum stress-depth and buckling-depth curves is minimized.

13. The apparatus of claim 1, wherein the projected axial lengths of the first and second transition sections are selected to produce structural failure, either material failure or buckling, concurrent to failure of the shell body polyhedral faces.

14. The apparatus of claim 1, wherein the polyhedral faces have geometries which depend on the operating pressure, shell body radius-to-thickness ratio, length-to-radius ratio and the number of axial and circumferential polyhedral faces.

15. A shell structure apparatus with buckling and pressure resistances, comprising an undulated shell body having plural polyhedral faces, first and second curved shell ends, and first and second transition sections, said transition sections having first straight edges at inner ends and second edges at opposite outer ends, said first edges being attached to edges of faces of the shell body and said second edges being curved and being attached to the curved shell ends, wherein the first and second transition sections have conoidal shapes.

16. A shell structure apparatus with buckling and pressure resistances, comprising an undulated shell body having plural polyhedral faces, first and second curved shell ends, and first and second transition sections, said transition sections having first straight edges at inner ends and second edges at opposite outer ends, said first edges being attached to edges of faces of the shell body and said second edges being curved and being attached to the curved shell ends, wherein the first and second transition sections comprise portions having alternating flat generally triangular faces and curved generally triangular faces.

17. A shell structure apparatus with buckling and pressure resistances, comprising an undulated shell body having plural polyhedral faces, first and second curved shell ends, and first and second transition sections, said transition sections having first staight edges at inner ends and second edges at opposite outer ends, said first edges being attached to edges of faces of the shell body and said second edges being curved and being attached to the curved shell ends, wherein the transition sections comprise alternative flat triangular faces and curved triangular faces.

18. PC shell apparatus comprising transition sections having first straight edges and second curved edges for attaching a PC shell body with plural polyhedral faces to first and second circular cylindrical rings, each ring having first and second edges, wherein the first edges are attached to hemispherical shell caps, and the second edges are attached to the transition sections.

19. The apparatus of claim 18, wherein the shell body is attached to the transition sections, which are attached to the cylindrical rings, which are attached to the shell caps and wherein each transition section has conoidal sections between the PC shell body and a cylindrical ring.

20. The apparatus of claim 18, wherein each transition section comprises portions having alternating flat triangular faces and curved triangular faces.

21. The apparatus of claim 18, wherein the transition sections comprise alternative flat triangular faces and curved triangular faces.

22. The apparatus of claim 18, wherein the polyhedral faces have geometries which depend on the operating pressure, shell body radius-to-thickness ratio, length-to-radius ratio and the number of axial and circumferential polyhedral faces.

23. A shell structure apparatus with buckling and pressure resistances, comprising an undulated shell body having plural polyhedral faces and first and second axial ends, first and second transition sections having straight edges and curved edges, said first and second transition sections being axially attached to the first and second shell body ends respectively, first and second cylindrical rings axially attached to the first and second transition sections respectively, and first and second end caps respectively connected axially to the first and second cylindrical rings.

24. The apparatus of claim 23, wherein the end caps are removable end caps, and further comprising pressure seals which are removably sealed to the rings for removal of the end caps from and replacement of the end caps on the rings.

25. The apparatus of claim 23, wherein the transition sections comprise alternative flat triangular faces and curved triangular faces.

26. The apparatus of claim 23, wherein the transition sections comprise first edges and second circular edges, said first edges being attached to the shell body ends, and said second edges being attached to the cylindrical rings.

27. The apparatus of claim 23, wherein the polyhedral faces have geometries which depend on the operating pressure, shell body radius-to-thickness ratio, length-to-radius ratio and the number of axial and circumferential polyhedral faces.

28. The apparatus of claim 23, wherein the faces are generally triangular in form and have top to base length ratios of from 0 to less than 1 and have base-side included angles of from about 20° to about 75°, depending on material, operating pressure or depth and application.

29. A PC shell structure apparatus with buckling and pressure resistance comprising an undulated shell body having a longitudinal axis and plural flat polyhedral faces formed as generally triangular shapes with apexes removed, top width to base length ratios selected to optimize structural performance such that differences between maximum stress-depth and buckling-depth curves are minimized, for reducing material stress and for maintaining buckling resistance, and having transition sections with first straight edges connected to the edges of the polyhedral faces, and second curved edges spaced from the first edges, and wherein a distance of the first edge from the longitudinal axis is similar to a distance of the second edge from the longitudinal axis.

30. The apparatus of claim 29, wherein the shell structure has first and second curved shell ends and first and second transition sections.

31. The apparatus of claim 30, further comprising providing fairings at the shell ends.

32. The apparatus of claim 30, wherein the transition sections have first edges at inner ends and second edges at opposite outer ends, said first edges being attached to the shell body and said second edges being attached to the shell ends.

33. A PC shell structure apparatus with buckling and pressure resistance comprising an undulated shell body having plural flat polyhedral faces formed as generally triangular shapes with apexes removed, top width to base length ratios selected to optimize structural performance such that differences between maximum stress-depth and buckling-depth curves are minimized, for reducing material stress and for maintaining buckling resistance, and having transition sections with first straight edges connected to the edges of the polyhedral faces, and second curved edges spaced from the first edges, further comprising a cylindrical fairing to the PC shell for reducing hydrodynamic drag and adding axial stiffness.

* * * * *